United States Patent [19]

Berzenye

[11] 3,992,048

[45] Nov. 16, 1976

[54] BELT CHAIN SLING

[76] Inventor: Michael L. Berzenye, 15147 Rayneta Drive, Sherman Oaks, Calif. 91403

[22] Filed: Mar. 19, 1975

[21] Appl. No.: 559,747

[52] U.S. Cl. ..... 294/74

[51] Int. Cl.[2] ..... B66C 1/18

[58] Field of Search..... 294/67 E, 67 EA, 74–77, 294/78 R; 24/116 R, 122.3, 122.6, 265 H, 265 AL; 59/78, 93; 214/86 A; 224/49; 245/1, 4, 5

[56] References Cited

UNITED STATES PATENTS

| | | | |
|---|---|---|---|
| 2,598,921 | 6/1952 | Knudsen | 294/74 |
| 2,793,903 | 5/1957 | Mallard | 294/74 |
| 2,960,365 | 11/1960 | Meisen | 294/74 |
| 3,167,344 | 1/1965 | Applegarth | 294/74 |
| 3,279,841 | 10/1966 | Whaples et al. | 294/74 |
| 3,360,293 | 12/1967 | Barthule | 294/74 |

FOREIGN PATENTS OR APPLICATIONS

| | | | |
|---|---|---|---|
| 1,446,406 | 12/1966 | France | 294/74 |
| 786,974 | 11/1957 | United Kingdom | 294/74 |
| 755,438 | 8/1956 | United Kingdom | 294/74 |

*Primary Examiner*—Johnny D. Cherry
*Attorney, Agent, or Firm*—Huebner & Worrel

[57] ABSTRACT

A belt chain sling for material handling, including a plurality of chain lengths, spacer means and means interlaced with said chain lengths for creating unitary movement and aligning the chain lengths yet allowing flexibility and non-kinking of the sling. The flexibility of the sling allows girdling or binding of material for either movement or tying down of the material.

7 Claims, 9 Drawing Figures

BELT CHAIN SLING

BACKGROUND OF THE INVENTION

Material handling or cargo slings have been in existence for many years. In principle the slings have been of a belt type where at each end there are provided handles having openings therein whereby the handles may be placed on a hook of a hoist once the material or cargo has been girdled by the belt and the material may then be lifted for movement. In some cases the belts terminate in the necessary hoist openings thereby eliminating the specific need for handles per se.

The most generally used slings have been fabricated from single to multiple strands of chain or wire rope lengths. Additionally, some slings are formed of fabric or synthetic material, particularly where a wide area of belting is necessary to engage material or cargo.

The aforementioned slings each has disadvantages which render them unsuitable for certain applications and additionally require high maintenance. As an illustration, when a single strand of chain has been used, the weight of the material being lifted has caused damage to the cargo where the chain strand "bites" into the cargo. Additionally, the use of multiple strands of chain, necessary when greater weight is to be lifted, will result in a "bunching" of the chain strands when the cargo is lifted which can compound the bits and cause damage to cargo. On the other hand, if fabric, rubber or synthetic material slings are utilized they have the disadvantage of not being able to sustain the loads which chains can and also have an additional disadvantage of being easily cut which further weakens the sling. This in turn demands a complete replacement of the sling which is both costly and time consuming.

SUMMARY OF THE INVENTION

In the present invention there is provided a belt chain sling which includes a plurality of lengths of chains which assure greater weight lifting capabilities, and an interlacing means between links of the various lengths and spacer means between the lengths whereby coaction of the lengths is assured and alignment of the lengths is possible. Such a structure creates a fixed width of the belt to assure a proper distribution of weight of the material or cargo lifted whereby "biting" and damaging of the material is minimized.

Additionally, the interlacing means will unite the chain lengths into an interacting web so that if there is a weight differrential in the material lifted due to irregular surfaces or unbalancing of the load the chain belt sling can adapt itself to the irregularity without weakening the sling. In addition to the use of the belt chain sling to surrounding material for lifting, the same structure can be utilized as a tie down member to retain material or cargo.

The belt chain sling of this invention utilizes a pair of conventional handles and secured to and extending between the handles in parallel relationship are equal length sections of straight length link chain. Additionally, the sling includes an interlacing or weaving of flexible material such as stranded wire rope betweeen alternate rows of links, and between the sections of chain and secured to the wire rope are spacer elements through which the wire rope is free to run whereby the sling is self-adjusting to the load it engages due to weight shift or irregular surfaces encountered thus leading greater total strength for the lifting of heavy objects.

Additionally, it is a further object of the invention to provide modified attachment means on the handles whereby greater pivoting of the sections or lengths of chains may be accomplished by a laterial shifting of the sections depending on the load encountered.

Further, there may also be provided a pad which is generally the length and width of the belt portion of the sling which can be attached or clipped to the chain or spacers to reduce abrasion of the material to be lifted.

Further objects and advantages of the invention may be brought out in the following part of the specification wherein details have been described for the competence of disclosure, without intending to limit the scope of the invention which is set forth in the appended claims.

DETAILED DESCRIPTION OF THE PREFERRED EMBODIMENT

Figure 1:
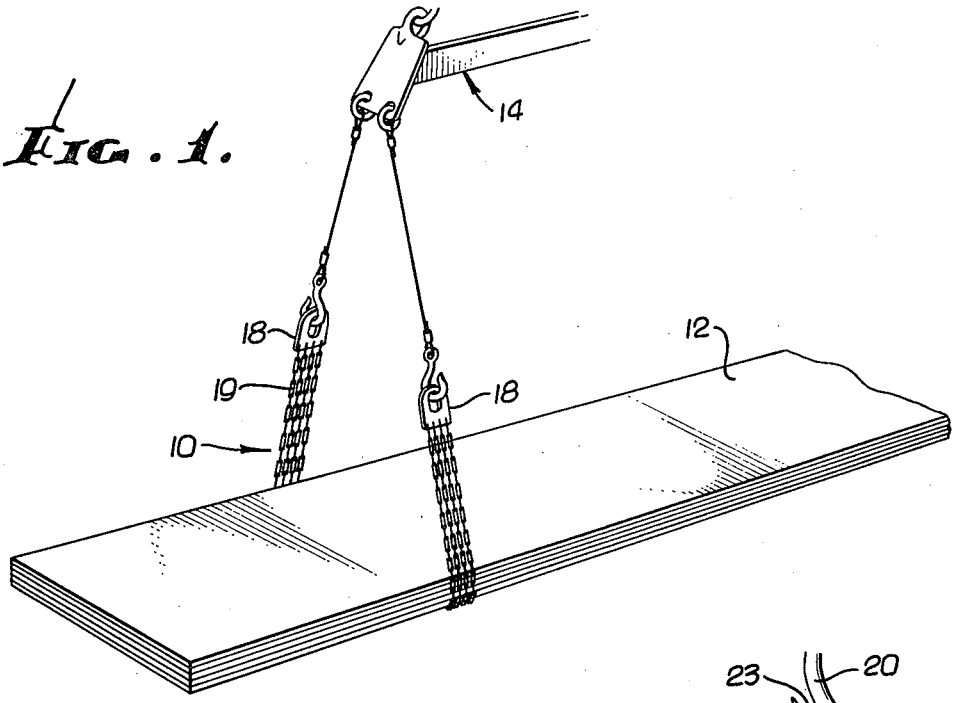
FIG. 1 is a perspective environmental view illustrating the belt chain sling of this invention in lifting engagement with material or cargo.

Referring now to the drawings in more detail, in FIG. 1 there is illustrated a belt chain sling generally designated 10 which is the subject of the present invention. The sling 10 is elongated with a length greater than its width and is flexible. The length of the sling 10 should be sufficient to extend around material which is to be lifted. In the illlustration of FIG. 1 there is shown material or cargo 12 which is generally flat where the sling 10 will extend around the cargo 12 and is attached to a conventional hoist or crane 14, partially illustrated, so that when the crane 14 is activated the material or cargo 12 may be lifted by the sling 10 and move from one place to another such as from a dock to the hold of a ship, loading dock to truck, etc.

Figure 2:
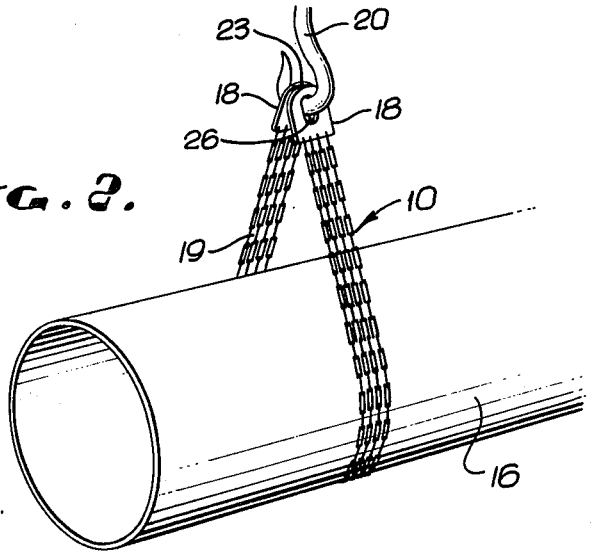
FIG. 2 is a perspective environmental view of the belt chain sling of this invention as it may be used on cylindrical material for lifting.

In FIG. 2 the sling 10 is shown as it might be used with regard to cargo 16 which is circular or curved and illustrates the flexibility of the sling 10. In this particular view the sling 10 is attached to a single hook 20 which in turn can be attached to a conventional hoist or crane in any convenient manner.

While the primary illustrations of this invention show the sling as used for the lifting of material or cargo it should be realized that the same sling 10 has the capability of being utilized as a tie down means to retain cargo or material in a fixed position such as on the deck of a ship, dock or a truck.

Figure 3:
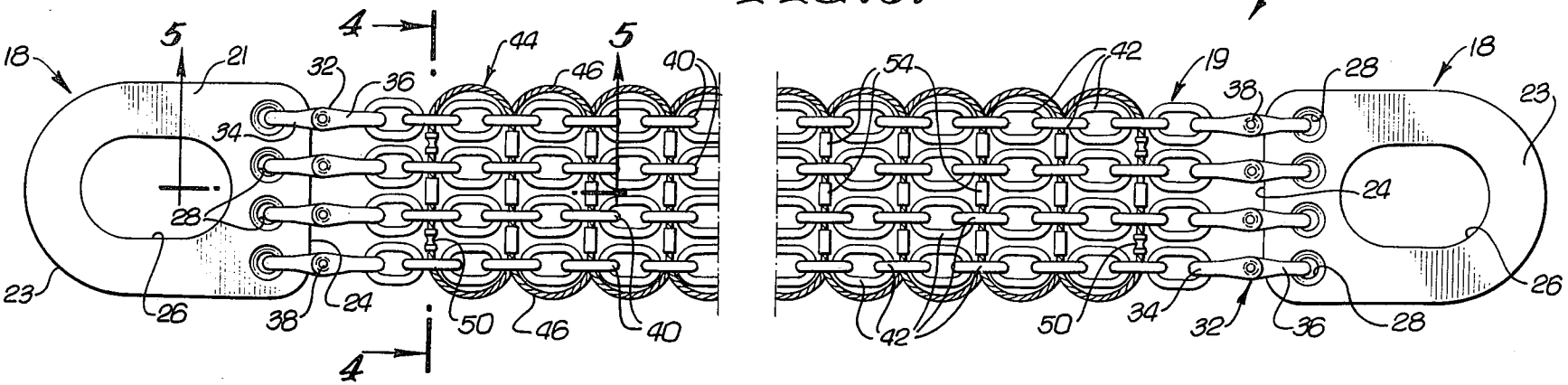
FIG. 3 is a top plan view of the sling in a flat non-cargo engaging position.

In FIG. 3 there is a detailed illustration of the subject matter of this invention which will now be described in further detail. The sling 10 is in general overall construction similar to conventional slings in that there are a pair of handles generally designated 18 and extending between the handles 18 is a flexible belt portion or webbing designated 19. The belt portion 19 is of any determined length sufficient to accomplish the purpose of surrounding material or cargo to be lifted and of a width sufficient to have the necessary strength for lifting cargo and stabilizing the same during lifting.

Figure 5:
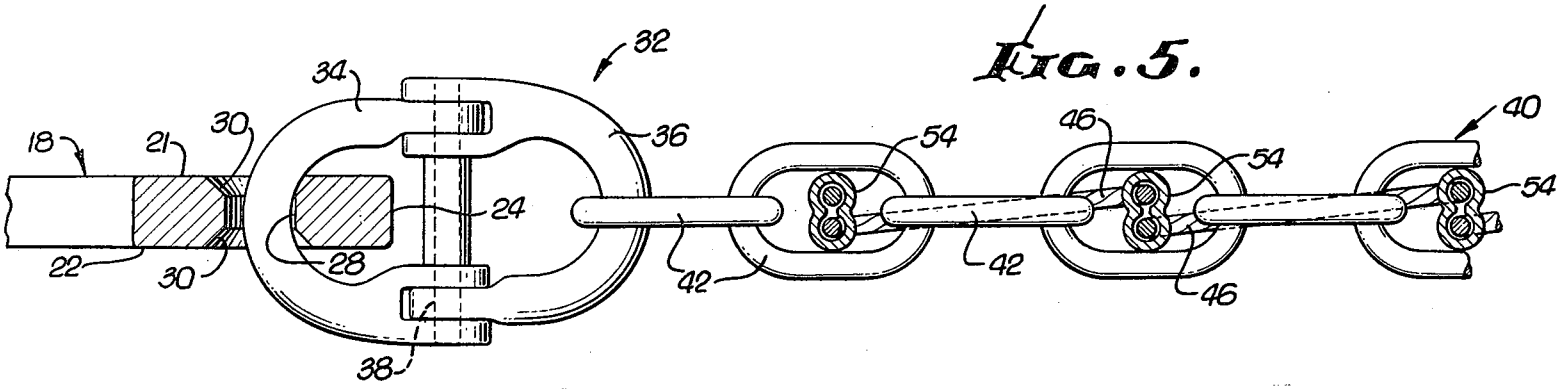
FIG. 5 is an enlarged cross sectional view taken on line 5—5 of FIG. 3.

Each of the handles 18 are preferably formed of alloy steel plate and is elongated with upper and lower surfaces 21 and 22 respectively. The handle is formed with an outer rounded end 23 and an inner end 24 preferably normal to an axis extending between the inner end 24 and outer end 23. Additionally, each handle 18 includes an internal hook opening 26 between the ends 23 and 24 extending through the handles. The hook 20 may be passed through the hook openings 26 as illustrated in FIGS. 1 and 2. Additionally, each of the handles 18 include a plurality of aligned bores 28 adjacent the inner end 24 extending through the handle 18 as best seen in FIG. 5. The number of bores 28 will depend upon the width of the sling 10 required and as is illustrated in the present invention for purposes of discussion there are four such bores 28. In order to prevent unnecessary binding of the belt portion 19 the bores 28 may include chamfers 30 at the top 21 and bottom 22 of the handle 18.

The preferred makeup of the belt portion 19 includes couplings generally designated 32 which are of a conventional two part type including generally U-shaped parts 34 and 36. U-shaped part 34 is adapted to extend through one of the openings 28 such as seen in enlarged detail in FIG. 5 and the U-shaped inner part 36 is adapted to mate with the inner U-shaped part 34 and the parts 34 and 36 are held in locked position by means of a pivot pin 38 passing through openings unnumbered in the ends of the parts 34 and 36. This allows the inner U-shaped parts to pivot relative to the other. While the coupling 32 is illustrated and described in the form abovementioned it should become apparent that any type of coupling means that will unite the belt portion 19 to the handle 18 is sufficient.

Turning now to the belt portion 19 per se, there are a plurality of sections of chain 40 wherein the chain 40 is made up of interconnecting links 42. Each of the sections 40, as can be seen from the drawings, is of equal length and each such section 40 has an end outer link 42 at each end forming a row of aligned links normal to the longitudinal axis of the belt portion 19 and secured through the inner U-shaped part 36 of the respective couplings 32. As the sections of chain 40 are equal in length the links 42 are aligned and successive rows of links are provided. In the preferred embodiment illustrated and described there are four such sections of chains 40. The sections of chains are of the conventional alloy steel type which preferably are heat treated to develop maximum strength consistent with proper ductility. The particular size of the individual links 42 and the material from which the links are forged is of course dependent upon the maximum weight characteristics of the material to be lifted.

Each row of links are alternately arranged whereby there is a row of links turned on a horizontal plane and then a row turned on a vertical plane or 90° from the previous row. This alternate positioning extends throughout the length of the sections.

In order to tie the respective sections of chains 40 in parallel and alternate planar arrangement and impart additional strength and elasticity and prevent non-kinking, there is provided an interlacing means generally designated 44 which is threaded between links 42 of the respective sections 40. The interlacing means 44 preferably is wire rope 46 which is of the conventional stranded variety.

Figure 4:
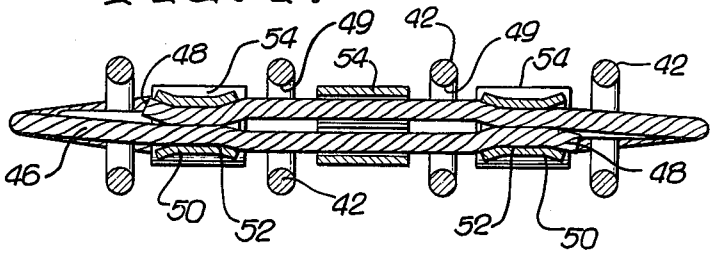
FIG. 4 is a cross sectional view taken on line 4—4 of FIG. 3 and rotated 90°.

In the embodiment illustrated, two pieces of wire rope 46 are utilized each having ends 48, see FIG. 4. The wire ropes 46 are passed through a row of vertically aligned links 42 which are the links next to the horizontal planar row of links attached to the couplings 32. The wire rope 46 is positioned through the links 42 in a vertical position one above the other as best seen in FIG. 4 and maintained in such vertical alignment as will become more apparent.

In order to retain and lock the ends 48 in position a pair of sleeve members 50 are spaced between the outer and inner chain links 42 respectively and swedged such as seen at 52 whereby the end 48 and a portion of the other wire rope 46 immediately below are locked in together so that the ends 48 cannot be withdrawn from the sleeve 50. Then the respective lengths of the wire ropes 46 extend outwardly beyond the outer links 42 of outer sections 40 and the opposite end 48 of one of the lengths of wire rope passes down the outside of an outer section of chain 40 and is threaded through a row of links 42 which have been vertically aligned and is once removed from the aforementioned initial row of links 42 and through corresponding aligned links forming the row of the other sections of chain 40 and out the opposite side. The rope 46 is pulled taught and through all the links 42 in that row. The remaining length of the wire rope 46 projecting out the other side is then passed through the next once removed row of links 42 which are vertically aligned such as seen in FIG. 5. This threading is continued until the opposite end 48 of the rope 46 is positioned within the links 42 at the opposite end of sections 40.

The next wire rope 46 extending out the other side of the belt portion 19 is then threaded in the same manner and through rhe same alternate rows of links 42. Thus it can be seen that there is an interlacing from each side throughout the length of the sections of chain 40.

As can be seen the inner diameter 49 of the individual links 42 is sufficient to receive the two diameters of wire rope 46 which pass therethrough.

In order to stabilize the respective wire ropes 46 in vertical alignment one above the other when extending through the links 42, spacer means or sleeves 54 are provided. In addition, the sleeves 54 because they are preferably each of equal length, will maintain each of the sections of chain 40 in parallel relation one to the other throughout the chain's entire length. The wire ropes 46 are threaded through the sleeves 54 which are positioned between the respective sections of chain 40.

Figure 6:
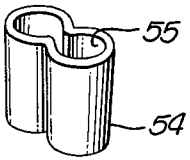
FIG. 6 is a perspective view of one form of spacer and alignment means used in the sling.

The spacer sleeves 54 such as illustrated in FIG. 6 preferably have a cross sectional interior of a figure eight wherein the diameter 55 of each of the sections of the figure eight corresponds with or is slightly greater than the diameter of the wire rope 46. While the preferred embodiment illustrates the use of figure eight sleeves 54, it should be recognized that any type of oval sleeve wherein the internal diameter corresponds with or is slightly greater than the diameter of the wire rope is sufficient as long as the wire rope 46 is maintained in a vertical alignment with one rope 46 above the other.

As stated above, each of the wire ropes 46 is interlaced through rows of links once removed from the preceding interlaced row of links until the wires extend through the row of links next to the links secured to the coupling at the end of the respective sections of chain 40. At the point the wire rope 46 is cut forming opposite ends 48 and the same sleeve members 50 are used to swedge the ends 48 to a section of the wire rope 46 such as is illustrated in FIG. 4.

In addition to the swedge sleeves 50 at the ends of the wire ropes 46 a spacer 54 is positioned between the two inner links such as again illustrated in FIG. 4.

Thus it can be seen that with the interlacing of the wire rope 46 in the various links of the chains 40, it is assured that each of the sections of chain 40 will be positioned so that the links are maintained in the vertical or horizontal position, best illustrated in FIG. 3, and by the use of the spacer sleeves 54 each of the sections 40 will be maintained in parallel spaced relationship one from the other.

By such a configuration and interlacing, it will be assured that the width of the belt portion 19 will be constantly interlocked throughout the entire length of the sling 10. In this way, no bunching of chain may be possible and it will assure a constant non-kinkable area of contact to support material or cargo during lifting operation and will prevent damage to the cargo. Further, with the interlacing of the respective sections of chain 40, there is a total cooperation and flexibility to allow a greater weight to be lifted than with ununited lengths of chain or cable. Further, should the sling 10 encounter any irregular cargo surface a shifting along the entire longitudinal axis between handles can be accomplished so that there will not be an undesirable overload in a specific portion of the entire sling. This is of course due to interaction of chain links 42 and rope 46. In other words, if, as an illustration, a projection on the material to be lifted engages one of the outer sections of chain 40 and depresses it, in effect shrinking the overall longitudinal length, there will be a compensation through the interlacing to the outer section on the opposite side whereby it will be shifted to a tightening position against the cargo.

While the lacing operation described above preferably includes the use of two wire ropes 46, it should be understood that a single strand of wire rope may be utilized whereby the threading may be commenced at one end of the sling and continuing to the opposite end and back again. Additionally, a single wire rope 46 can be utilized which commenced at one end of the belt portion 19 and is threaded from alternate sides to the other end of the portion 19 and secured in place. When this latter single stranding is used the interior of the spacers 54 do not have to accommodate but one diameter of the rope 46.

Additionally it is contemplated that individual strands of wire rope 46 can be utilized to pass through each of the aligned links 42 and swedged or otherwise locked beyond the exterior of the outer sections of chain 40. However, it has been determined that such construction does not create the best inter-reaction throughout the entire sling.

Figure 8:
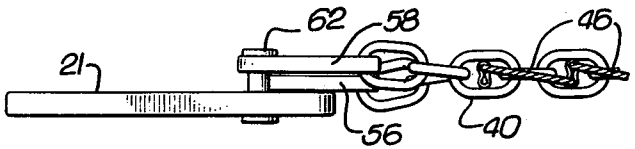
FIG. 8 is a side elevational view partly in section of the modification of FIG. 7 taken on line 8—8 of FIG. 7.
Figure 7:
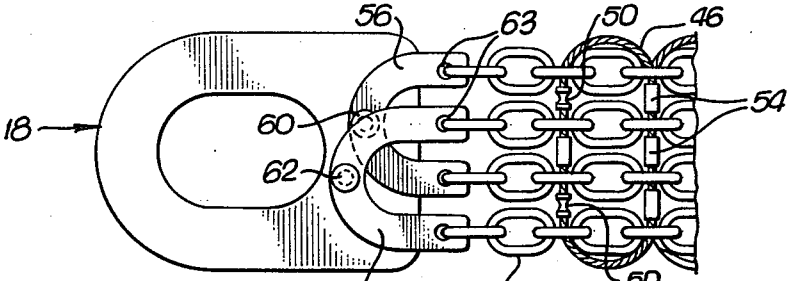
FIG. 7 is a top plan view similar to FIG. 3 of a modified form of the invention relative to the handles of the belt chain sling.

FIGS. 7 and 8 illustrate modified forms of connecting the sling portion to the handles 18. In this particular embodiment there is provided a pair of U-shaped coupling members 56 and 58. Each of these coupling members are pivotally mounted on the handle 18 through pivot pins 60 and 62, respectively, which project through top surface 21 of the handle 18 as best seen in FIG. 8. At the end of each of the arms of the respective U-shaped coupling members 56 and 58 holes 63 are provided. As can be seen in FIG. 7, U-shaped coupling member 56 is mounted to one side of the longitudinal axis of the handle 18 and relatively snug to the upper surface 21 of the handle 18. The other U-shaped coupling member 58 is mounted on the opposite side of the axis of the handle 18 and the pin 62 is of a greater length so that the coupling member 58 overlies the coupling 56.

With the U-shaped coupling members 56 and 58 as illustrated an outer section of chains 40 is secured through the hole 63 to one arm of the coupling 56 and the section once removed inwardly from the outer section 40 is secured to the other arm of the coupling 56. With regard to the coupling 58 the opposite outer section of chain 40 is secured to the outer arm of the coupling 58 and the inner section once removed is in turn connected to the other arm of coupling 58. The same connection is repeated for the opposite handle 18.

With such a structure as illustrated in FIGS. 7 and 8 it can be seen that any irregular surface encountered by the sling when engaging a material or cargo will allow the sling to pivot through pivot pins 60 or 62 to properly seat and adjust itself whereby full surface contact of the sling with the cargo is achieved. In other words, if the outer arm 56 is pivoted inwardly then the outer arm of coupling 58 will be pivoted outwardly to compensate in view of the interlacing of the respective sections of chain 40 and in its way there is an assured opposite reaction for every action.

Figure 9:
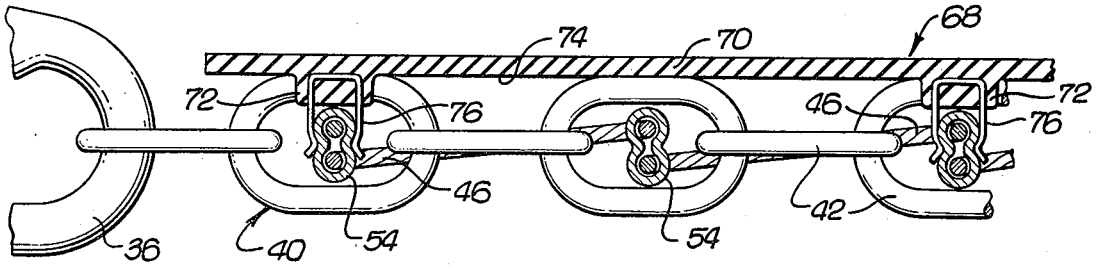
FIG. 9 is a side elevational view partly in section of a pad means which may be utilized with the sling to prevent abrasion of the material being lifted.

In FIG. 9 there is illustrated a modification of the invention which includes the addition of a pad 68 which is preferably of rubber or plastic 70 of a length and width corresponding to the belt portion 19 of the sling. In order to attach the pad 68 to the sling there is preferably provided downward projections 72 struck from the undersurface 74 of the pad 68. Molded or otherwise secured within the downward projections 72 are clips 76 which are of a diameter sufficient to snap onto the exterior of several of the spacer sleeves 54. In this way it can be assured that the pad 68 will remain in position. The purpose of the pad 68 is to give additional protection in the case of lifting material or cargo where it is critical that no damage or abrasion to the material be imparted through lifting and rubbing against the sling.

Although I have herein shown and described my invention in what I have conceived to be the most practical and preferred embodiment, it is recognized that departures may be made therefrom within the scope of my invention.

I claim:

1. A belt chain sling for material handling comprising:

a pair of handles, a belt portion of predetermined length and width extending between said handles and having ends each of which is respectively connected to one of said handles, said belt portion including a plurality of sections of chain and interlacing means associated with said sections of chains to stabilize said sections of chain and create a coaction between the same;

said sections of chain are composed of interconnection links and all of the sections are of equal length and are arranged in general parallel elongated relationship one with the other, and there are two outer sections of chains;

each link of each section of chain across the width of said belt portion is aligned forming rows, and each row of links commencing from the row attached to the handles is alternately arranged on a horizontal plane and a vertical plane, and said interlacing means pass through said vertically arranged rows of links whereby said rows of said links will be maintained in said alternate planar arrangement; and spacer means are associated with said interlacing means and are interposed between said links of each of said vertically arranged rows whereby said sections of chain are maintained in parallel relationship.

2. A belt chain sling as defined in claim 1 wherein said spacer means includes a plurality of collars each having an inside diameter sufficient to receive said interlacing means.

3. A belt chain sling as defined in claim 1 wherein there is provided a pad of a length and width generally corresponding with said belt portion and adapted to be detachably secured to said belt portion to reduce abrasion to material handled by said sling.

4. A belt chain sling as defined in claim 1 wherein clips are provided on said pad to effect detachable securement of said pad to said belt portion.

5. A belt chain sling for material handling comprising:

a pair of handles, a belt portion of predetermined length and width extending between said handles and having ends each of which is respectively connected to one of said handles, said belt portion including a plurality of sections of chain and interlacing means associated with said sections of chain to stabilize said sections of chain and create a coaction between the same;

said sections of chain are composed of interconnected links and all of the sections are of equal length and arranged in general parallel elongated relationship one with the other, and there are two outer sections of chains;

each link of each section of chain across the width of said belt portion is aligned forming rows, and each row of links commencing from the row attached to the handles is alternately arranged on a horizontal plane and a vertical plane, and said interlacing means pass through said vertically arranged rows of links whereby said rows of said links will be maintained in said alternate planar arrangement;

said interlacing means includes two laces having ends and each lace being threaded through said rows of links from opposite sides of said outer sections of chain whereby each threaded row has a portion of the two laces therethrough, and said laces being secured together at said ends within rows of links of said sections of chain to prevent unthreading; and spacer means are associated with said interlacing means and includes a plurality of spacer collars positioned between said vertically arranged links of each of said rows and said laces are threaded through said collars, and said collars have an interior cross sectional configuration whereby said laces are maintained in vertical alignment one above the other.

6. A belt chain sling as defined in claim 2 wherein the interior cross-sectional configuration of said collar is a substantial figure eight whereby the portions of said laces passing through said rows are spaced vertically one from the other.

7. A belt chain sling for material handling comprising:

a pair of handles, a belt portion of predetermined length and width extending between said handles and having ends each of which is respectively connected to one of said handles, said belt portion including a plurality of sections of chain and interlacing means associated with said sections of chain to stabilize said sections of chain and create a coaction between the same;

each of said sections of chain are connected to said handles by movable coupling means;

said coupling means are pivotably connected to said respective handles; and said coupling means includes a first U-shaped coupling pivotally mounted on each of said handles with a pair of arms extending inward from said handles, a second U-shaped coupling partially overlying said first U-shaped coupling and pivotally mounted on each of said handles with a pair of arms extending inwardly from said handles and one of said arms of said second coupling spaced laterally between said pair of arms of said first coupling and each arm receiving the end of one section of chain.

* * * * *